US007134260B2

(12) United States Patent
Haloila

(10) Patent No.: US 7,134,260 B2
(45) Date of Patent: Nov. 14, 2006

(54) WRAPPING PACKAGING MACHINE

(75) Inventor: Arno Haloila, Rymättylaä (FI)

(73) Assignee: Octomeca Oy, Naantali (FI)

( * ) Notice: Subject to any disclaimer, the term of this patent is extended or adjusted under 35 U.S.C. 154(b) by 0 days.

(21) Appl. No.: 10/784,468

(22) Filed: Feb. 24, 2004

(65) Prior Publication Data

US 2004/0231302 A1 Nov. 25, 2004

(30) Foreign Application Priority Data

Feb. 25, 2003 (FI) ..... 20030281

(51) Int. Cl.
*B65B 11/00* (2006.01)

(52) U.S. Cl. ..... 53/588; 53/589; 53/210

(58) Field of Classification Search ..... 53/588, 53/204, 556, 210, 399, 589
See application file for complete search history.

(56) References Cited

U.S. PATENT DOCUMENTS 4,117,650 A * 10/1978 Ito et al. ..... 53/587
4,723,393 A * 2/1988 Silbernagel ..... 53/556
5,768,862 A * 6/1998 Mauro ..... 53/556
5,829,234 A * 11/1998 Suolahti ..... 53/556
6,247,294 B1 * 6/2001 Suolahti ..... 53/588
6,520,445 B1 * 2/2003 Araujo ..... 242/434.5
6,574,941 B1 * 6/2003 Neri ..... 53/399
6,775,961 B1 * 8/2004 Cook et al. ..... 53/556
6,786,026 B1 * 9/2004 Helmrich ..... 53/589
6,826,893 B1 * 12/2004 Cere' ..... 53/556
6,848,239 B1 * 2/2005 Shibazaki et al. ..... 53/399
6,880,311 B1 * 4/2005 Winkler ..... 59/399

* cited by examiner

*Primary Examiner*—Sameh H. Tawfik
(74) *Attorney, Agent, or Firm*—Kubovcik & Kubovcik

(57) ABSTRACT

A wrapping packaging machine (10) for the wrapping of an object (11), comprising a track (20) having the shape of a closed loop. The track carries a wrapping film (42) feed device (40) placed in conjunction with an elongated body (30), such as a flexible band or chain. The object is moved by a drive (21) provided in conjunction with the track, by using friction or a toothing (32). The track is openable, allowing one track half (20*a*) to be moved or turned aside to permit a change of the flexible body and the plastic film band roll (41).

19 Claims, 15 Drawing Sheets

WRAPPING PACKAGING MACHINE

SUBJECT OF THE INVENTION

The present invention relates to a wrapping packaging machine for the packaging of an object, said wrapping packaging machine comprising a track disposed mainly around the object to be packaged, at least one film feed device carrying at least one wrapping film roll for wrapping a plastic film band around the object to be packaged, and a drive for moving the film feed device around the object to be packaged.

PRIOR ART

Patent specification EP 0743913 B1 discloses a wrapping packaging machine for the packaging of a ring-like object. The device described in the specification comprises an openable loop-shaped track, along which a wrapping film feed device circulates to wrap a plastic film band around a ring-like object. The feed device circulating along the track is provided with an electric motor driving the feed device. The power transmission of the feed device is implemented in such manner that the electric motor drives a sprocket comprised in the feed device and engaging a toothed ring on the inner surface of the loop-shaped track. Electric power to the electric motor of the feed device is supplied via guide rails placed on one side of the loop-shaped track.

In the prior-art wrapping packaging machine disclosed in specification EP 0743913 B1, there are problems due to the fact that the electric conductors are placed in the openable loop-shaped track. The structure of the conductor rails of the openable track has to be made very accurate e.g. by machining to ensure that the collectors will work properly without disturbances. Such a structure is very expensive. Further, the toothed ring on the inner surface of the loop-shaped track is also difficult and expensive to manufacture. The joints of the toothed ring involve additional problems, and so do the joints of the conductor rails.

OBJECT OF THE INVENTION

The object of the present invention is to achieve a wrapping packaging machine that does not have the above-described drawbacks.

FEATURES OF THE INVENTION

The wrapping packaging machine of the invention is characterized in that the drive of the wrapping packaging machine comprises at least one elongated body, preferably a flexible rod, band, chain or equivalent, at least one drive element, such as a drive wheel, an endless band or equivalent for moving the elongated body along the track, and that the wrapping packaging machine comprises at least one film feed device, connected to the elongated body either directly or via at least one connecting element, for moving it around the object to be packaged.

EMBODIMENTS OF THE DEVICE OF THE INVENTION

An embodiment of the wrapping packaging machine of the invention is characterized in that it comprises two or more film feed devices connected to the elongated body on the track of the wrapping packaging machine that the wrapping film rolls of the film feed devices comprise wrapping film rolls containing similar or dissimilar plastic film bands.

A second preferred embodiment of the wrapping packaging machine of the invention is characterized in that the track of the wrapping packaging machine is of a loop-shaped, preferably circular or oval form or a rectangular track with rounded corners.

A third preferred embodiment of the wrapping packaging machine of the invention is characterized in that the plane passing through the track of the wrapping packaging machine is preferably vertical or horizontal.

A fourth preferred embodiment of the wrapping packaging machine of the invention is characterized in that the elongated body on the track is made of flexible material, such as plastic or rubber, adapting to the shape of the track.

A fifth preferred embodiment of the wrapping packaging machine of the invention is characterized in that the drive wheel in the track is a friction wheel for moving the elongated body on the track by friction.

A sixth preferred embodiment of the wrapping packaging machine of the invention is characterized in that the elongated body on the track is a chain adaptable to the shape of the track.

A seventh preferred embodiment of the wrapping packaging machine of the invention is characterized in that the drive wheel in the track is a toothed wheel, and that the elongated body on the track is provided with a toothing corresponding to the teeth of the toothed wheel and engaging the toothed wheel.

An eighth preferred embodiment of the wrapping packaging machine of the invention is characterized in that the loop-shaped track of the wrapping packaging machine can be opened to allow the track to be placed so that it runs through a ring-shaped object to be packaged, that the elongated body can be moved on the loop-shaped track to wrap a plastic film band around the ring-shaped object.

A ninth preferred embodiment of the wrapping packaging machine of the invention is characterized in that the openable track having the shape of a closed loop of the wrapping packaging machine has been formed from two parts, at least one of which can be moved sideways perpendicularly to the plane of the track.

A tenth preferred embodiment of the wrapping packaging machine of the invention is characterized in that the openable track having the shape of a closed loop of the wrapping packaging machine has been formed from two parts with a joint between them, and that at least one of the two parts of the track can be turned sideways about the joint so that the planes passing through the track parts form an acute angle between themselves.

An eleventh preferred embodiment of the wrapping packaging machine of the invention is characterized in that the wrapping packaging machine comprises means for removing the elongated body from the loop-shaped track and/or for feeding the elongated body onto the loop-shaped track when at least one of the track parts has been moved or turned aside.

A twelfth preferred embodiment of the wrapping packaging machine of the invention is characterized in that the wrapping packaging machine comprises two tracks, of which a first track carries the elongated body while a second track carries at least one carriage provided with at least one film feed device.

A further preferred embodiment of the wrapping packaging machine of the invention is characterized in that the first, outer track of the wrapping packaging machine carries the elongated body, which is supported by bearing rollers, while the second, inner track consisting of a guide rail supports the carriage of the film feed device, and that the elongated body and the carriage are connected together by a connecting element, such as a connecting rod.

EXAMPLES OF EMBODIMENTS

In the following, the invention will be described with reference to examples and the attached drawings, wherein

LIST OF FIGURES

FIG. 1 presents a diagrammatic side view of a wrapping packaging machine according to the invention.

FIG. 2 corresponds to FIG. 1 and presents a diagrammatic view of another wrapping packaging machine according to the invention.

FIG. 3 corresponds to FIG. 1 and presents a diagrammatic view of a third wrapping packaging machine according to the invention.

FIG. 4 presents a detail of the wrapping packaging machine.

FIG. 5 presents a section taken along line V—V in FIG. 4.

FIG. 6 corresponds to FIG. 4 and presents a detail of the wrapping packaging machine according to the second embodiment.

FIG. 7 presents a section taken along line VII—VII in FIG. 6,

FIG. 8 corresponds to FIG. 4 and presents a detail of the wrapping packaging machine according to the third embodiment.

FIG. 9 presents a diagrammatic side view of a fourth wrapping packaging machine according to the invention.

FIG. 10 is a diagrammatic illustration of the act of opening the loop-shaped track of the wrapping packaging machine of the invention.

FIG. 11 corresponds to FIG. 10 and illustrates the act of opening the loop-shaped track of the wrapping packaging machine according to the second embodiment.

FIG. 12 presents a perspective view of a fifth wrapping packaging machine according to the invention and its roll changing device.

FIG. 13 corresponds to FIG. 12 and illustrates another situation in the operation of the wrapping packaging machine.

FIG. 14 presents a diagrammatic side view of a sixth wrapping packaging machine according to the invention.

FIG. 15 presents a section taken along line XV—XV in FIG. 14.

FIG. 16 presents a diagrammatic illustration of the act of opening of the loop-shaped track of the wrapping packaging machine according to a third embodiment.

FIG. 17 corresponds to FIG. 1 and presents a diagrammatic view of a wrapping packaging machine according to the invention in which the track is a rectangle with rounded corners.

FIG. 18 presents diagrammatic side view of a seventh wrapping packaging machine according to the invention.

FIG. 19 presents a diagrammatic side view of an eighth wrapping packaging machine according to the invention.

FIG. 20 presents a diagrammatic side view of a ninth wrapping packaging machine according to the invention.

The drives 21*a*–21*c* are preferably electric motors, imparting rotation to the drive wheels 22*a*–22*c* either directly or via a gear system. The drive wheels 22*a*–22*c* engage the elongated body 30 e.g. by friction or by a suitable toothing. The elongated body 30 and/or the track 20 may be provided with rollers to reduce the friction between the track 20 and the body 30.

Figure 1:
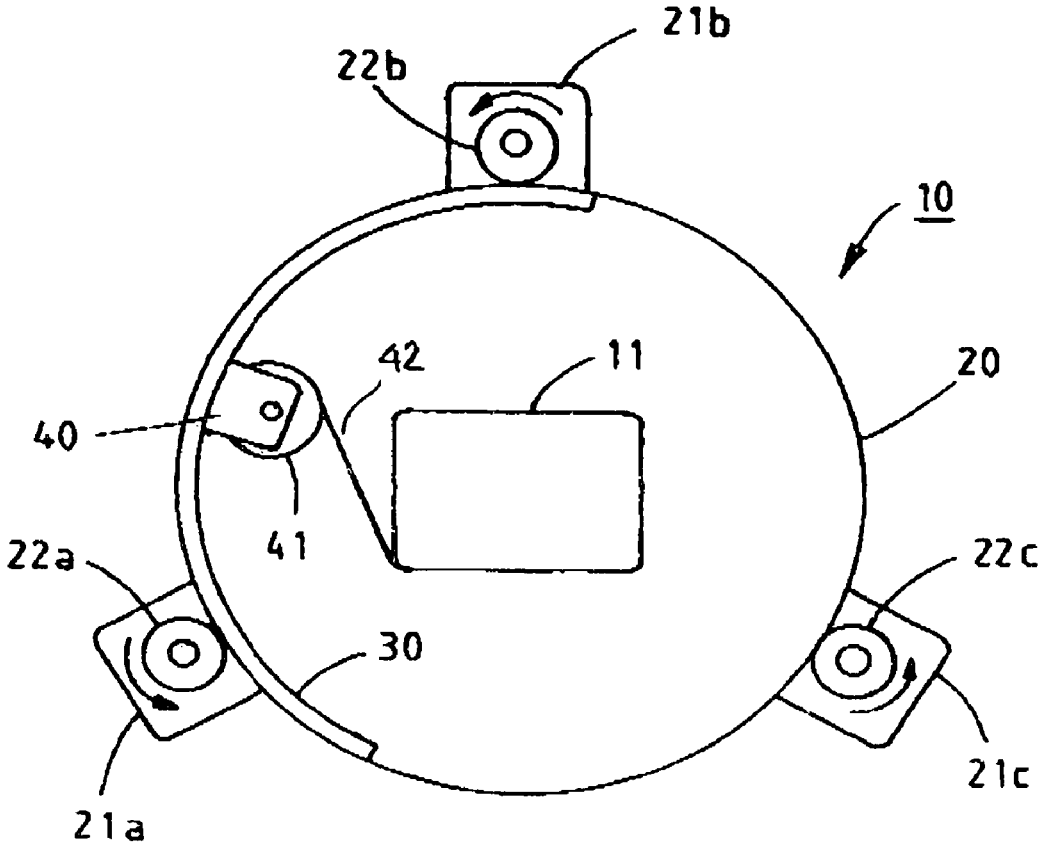
FIG. 1 presents a diagrammatic view of a wrapping packaging machine 10 according to the invention, with an object 11 placed inside the circular track 20 of the machine. A film feed device 40 and a film roll 41 containing wrapping plastic is placed on an elongated and flexible body 30 on the track 20, said body being moved along the track by means of three drives 21*a*, 21*b* and 21*c*. The length of the elongated body 30 has been so fitted that as the body is moving on along the track 20, at least one of the drives is continuously in contact with the body 30, thus ensuring that the body 30 will be moving continuously during the wrapping operation.
Figure 2:
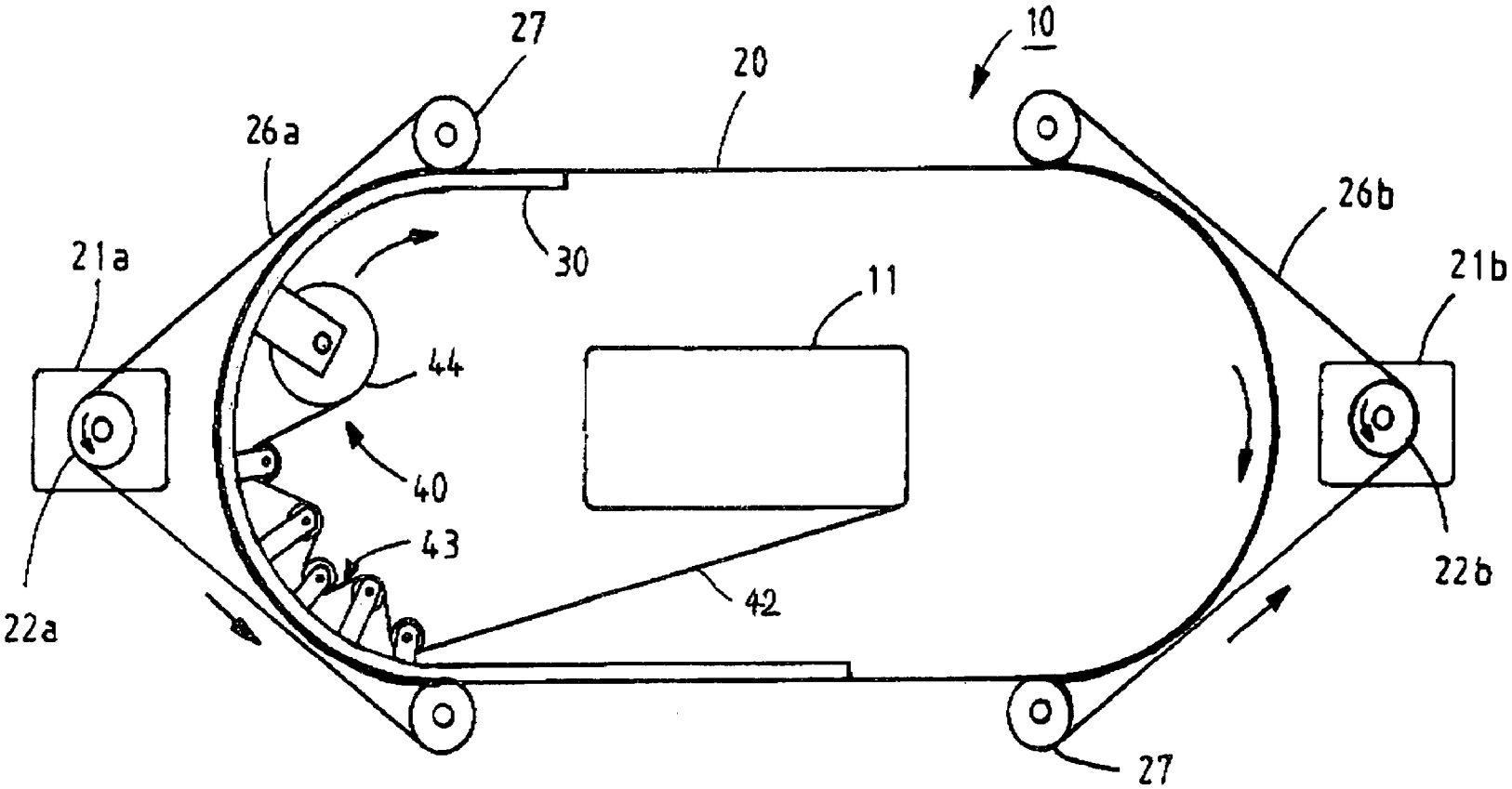

FIG. 2 presents a diagrammatic view of a second wrapping packaging machine 10 according to the invention. In this embodiment, the track 20 is of an oval form, in which case wide and low objects to be packaged can advantageously be placed inside it. Mounted at each end of the track 20 are drives 21*a* and 21*b*, each drive comprising an endless band 26. Both bands 26*a* and 26*b* engage a considerably large portion of the length of the track 20 by means of diverting pulleys 27, so that the two drives 21*a* and 21*b* are sufficient to ensure a contact between the bands and the flexible body 30 at every point of its path around the track. Placed on the flexible body 30 on the track is a film feed device 40, which comprises a plastic film roll 41 and a set of spring rollers 43.

Figure 3:
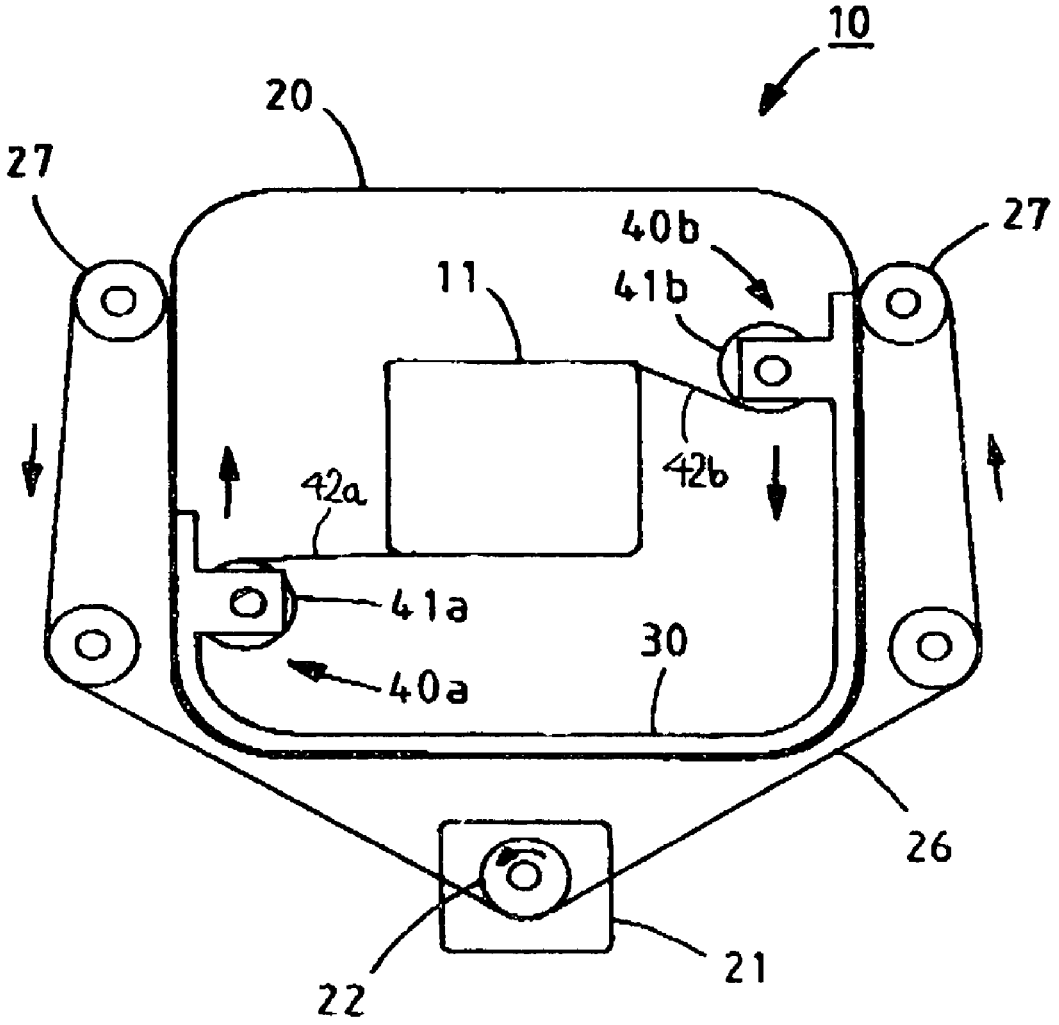

The track 20 of the wrapping packaging machine 10 in FIG. 3 has the shape of a square with rounded corners and it has only one drive 21 and one endless band 26. However, by means of diverting pulleys 27, the band 26 can be brought into contact with the track 20 on nearly three quarters of the length of the track. In this embodiment, two film feed devices 40*a* and 40*b* are mounted on the flexible body 30 placed on the track 20.

Figure 4:
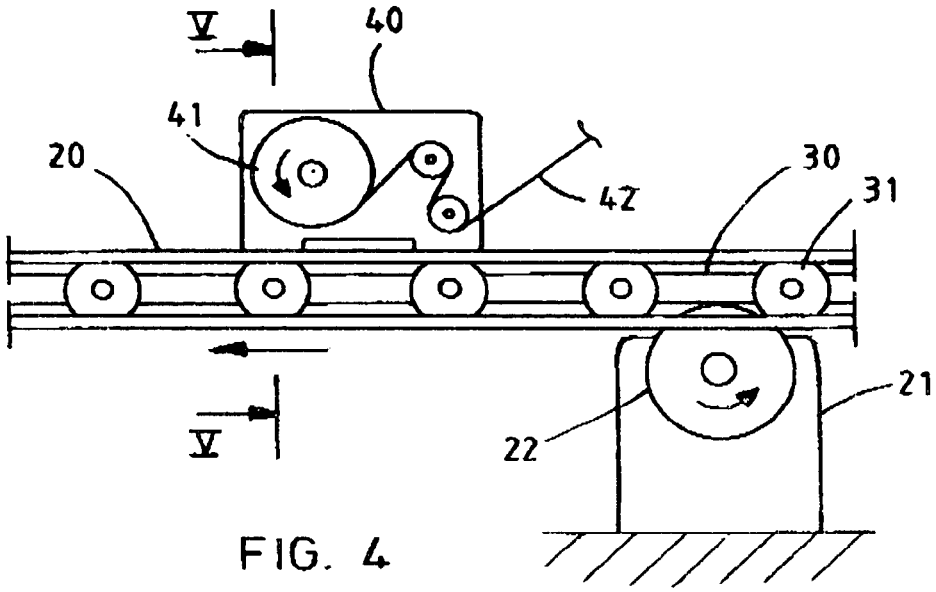

FIG. 4 presents a detail of the wrapping packaging machine 10 according to an embodiment of the invention, showing the elongated flexible body 30 on the track 20. In this embodiment, the elongated body 30 is provided with rollers 31. The body 30 is made of e.g. flexible band material, such as plastic or rubber, or it is a chain with a film feed device 40 attached to it for feeding plastic film 42 from the film roll 41, the film being passed around the object to be packaged. The body 30 is moved along the track by means of the drives 21 and their drive wheels 22.

Figure 5:
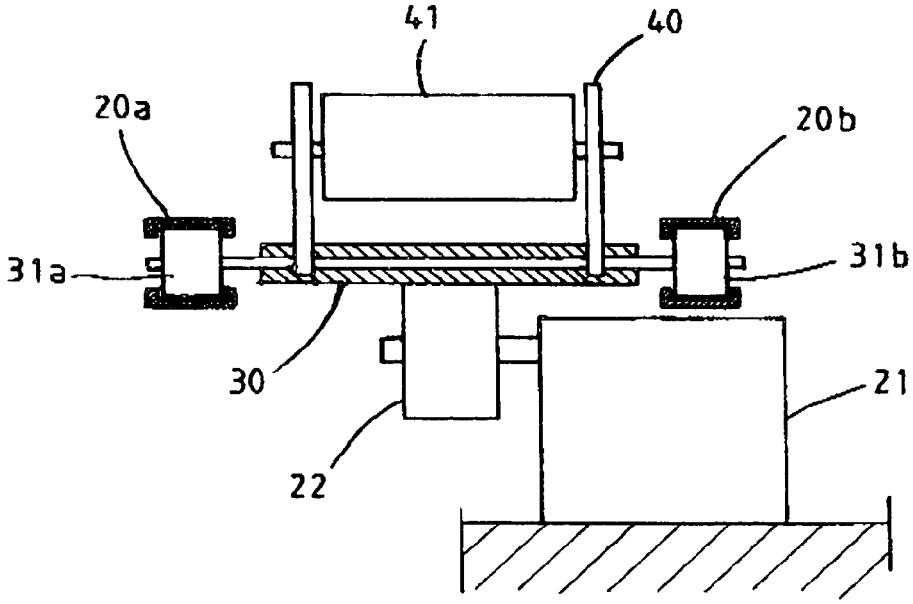

FIG. 5 presents a cross-section of the track 20 of the wrapping packaging machine 10 presented in FIG. 4. The elongated body 30, consisting of a flexible band, is mounted by means of rollers 31*a*–31*b* in the guide rails 20*a*–20*b* of the track. Connected to the band 30 is a film feed device 40 with a film roll 41. The band 30 is moved by the drive wheel 22 rotated by the drive 21.

Figure 6:
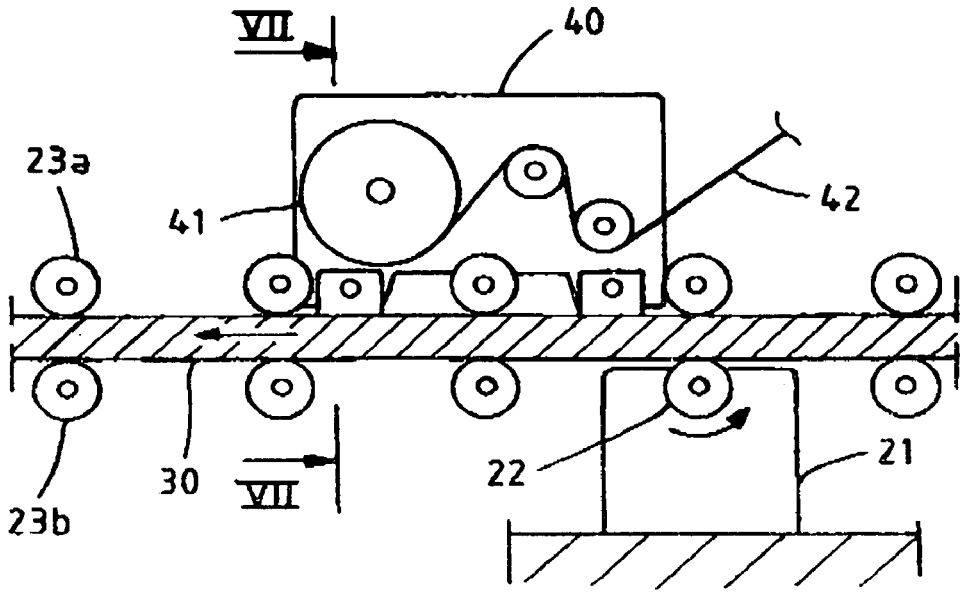

FIG. 6 presents a detail of the wrapping packaging machine 10 according to another embodiment. In this case, too, the elongated body 30 is a flexible band, to which the film feed device 40 with a film roll 41 is attached. By difference from the embodiment illustrated in the preceding figures, the flexible band 30 has no rollers, but its supporting rollers 23*a*–23*b* are placed in the track 20 on either side of the band 30. The drive wheel 22 of the drive 21 simultaneously functions as a band supporting roller below the band 30.

Figure 7:
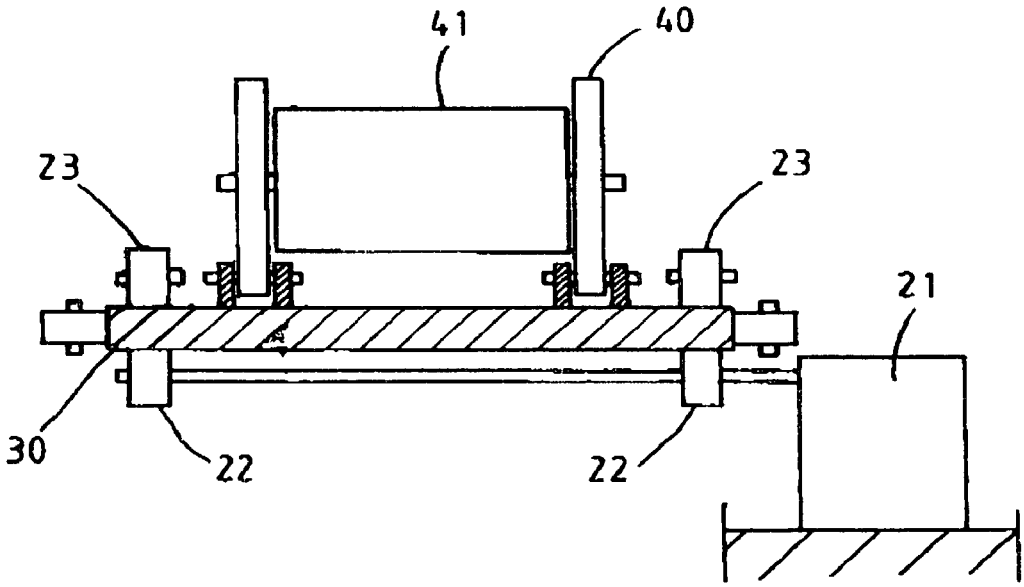

FIG. 7 presents a cross-section of the track 20 of the wrapping packaging machine 10 in FIG. 6. The flexible band 30 is shown at the level of the drive 21, between the supporting rollers 23 of the track and the drive wheels 22 of the drive 21. Attached to the band 30 is a film feed device with a film roll 41.

Figure 8:
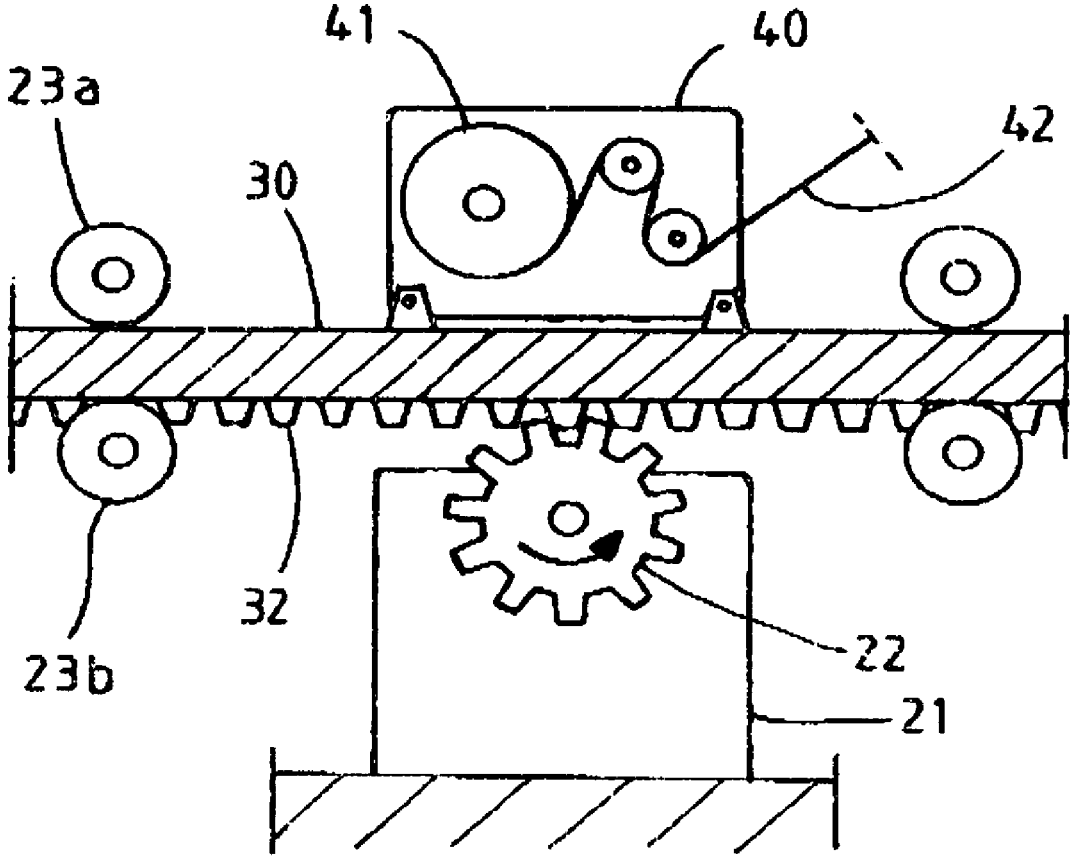

In the embodiment presented in FIG. 8, as in the embodiments illustrated in the two preceding figures, the flexible band 30 provided with a film feed device 40 is between the supporting rollers 23*a*–23*b* of the track, but additionally the lower surface of the band 30 is provided with a toothing 32. In this case, the drive wheel 22 of the drive 21 is a toothed wheel matching the toothing 32 of the band 30.

Figure 9:
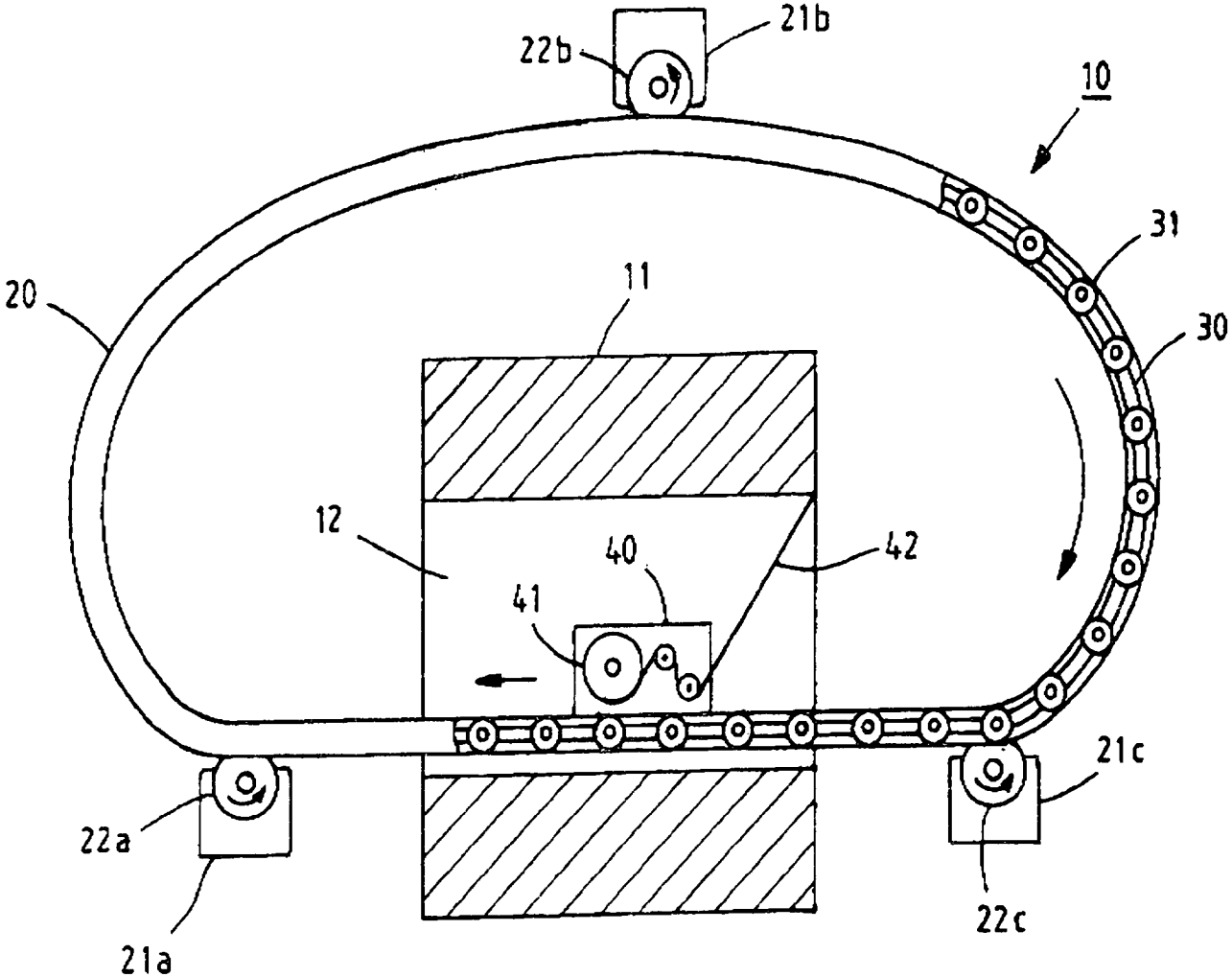

FIG. 9 presents a diagrammatic side view of a wrapping packaging machine 10 for wrapping an ring-shaped cylindrical object. Before the wrapping operation is started, the loop-shaped track 20 has to be first opened and then closed again so that the track 20 passes through the aperture 12 of the ring-shaped cylindrical object to be packaged 11. During the wrapping operation, the film feed device 40 on the closed track 20 circulates along the track 20, plastic film band 42 obtained from the plastic film roll 41 being thus wrapped around the ring-shaped object 11.

Figure 10:
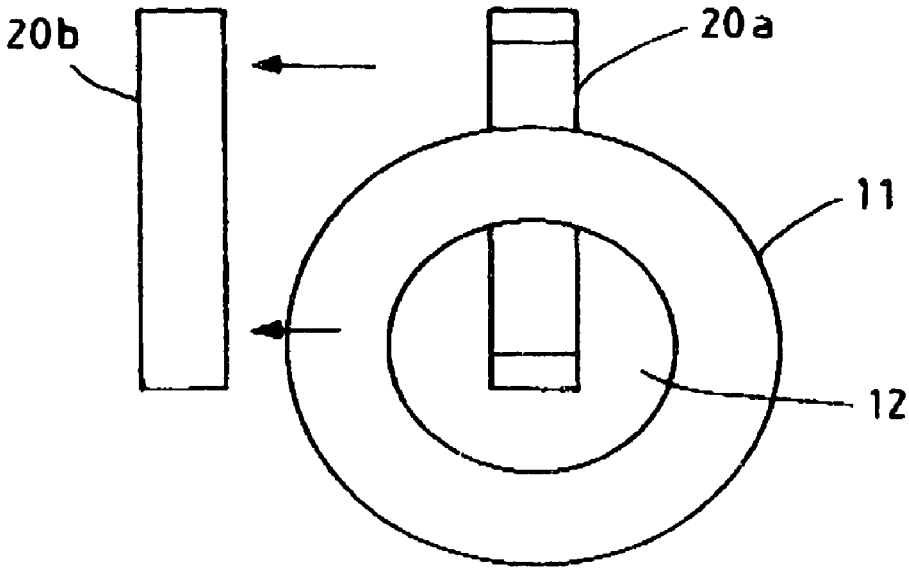

FIG. 10 presents a diagram illustrating the act of opening the loop-shaped track 20 according to the invention in such manner that one half 20*a* of the track remains stationary relative to the object to be packaged 11 while the opposite half 20*b* of the track is moved sideways. In this way, the two halves 20*a* and 20*b* of the track are moved far enough apart to provide a sufficient space near their ends. This allows the elongated body 30 of the invention to be freely fed into any one of the track halves 20*a* and 20*b* or removed from them. This is advantageous because a change of the wrapping film roll can be carried out simply by only replacing the elongated body 30 on the track 20 with another one.

Figure 11:
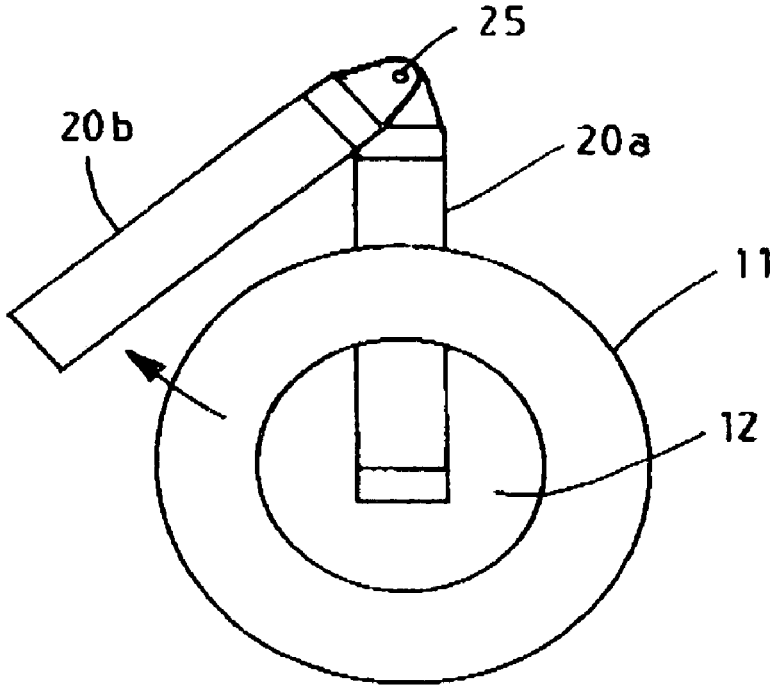

FIG. 11 illustrates another solution for opening the loop-shaped track 20 of the wrapping packaging machine. In this figure, the two halves 20*a* and 20*b* of the track are connected together by a joint 25. In this case, the closed loop-shaped track can be opened simply by turning one 20*b* of the track halves aside. This is another way of moving the track halves 20*a* and 20*b* far enough apart to provide a sufficient space near their ends to allow a change of the elongated body 30 and at the same time the roll.

Figure 12:
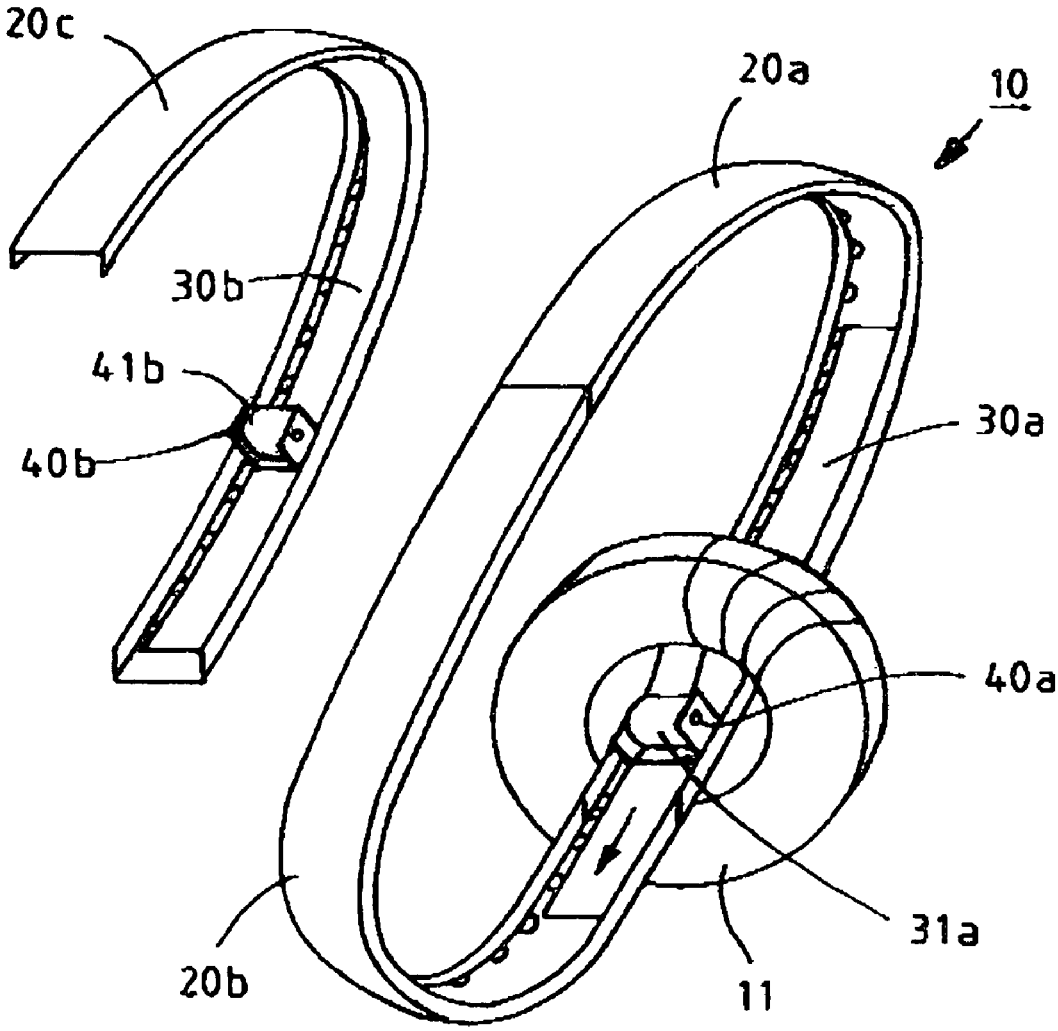

FIG. 12 presents a diagrammatic perspective view of an embodiment of the wrapping packaging machine 10 of the invention wherein the track 20 can be divided into two parts 20*a* and 20*b*. In the situation illustrated in FIG. 12, the track 20 has been placed to pass through the aperture 12 of a ring-shaped cylindrical object 11, allowing the ring-shaped object 11 to be wrapped.

In FIG. 12, the track 20 formed by the two halves 20*a* and 20*b* carries a flexible elongated body 30*a* and a film feed device 40*a* attached to it and a film roll 41*a*, which move along the track to wrap a ring-shaped object 11. Beside the track 20 in operation there is a third track half 20*c*, which is designed to serve as a roll change unit. It comprises another elongated body 30*b* and a film feed device 40*b* attached to it, with a full film roll 41*b* ready for use.

When the film roll 41*a* used in the wrapping process in FIG. 12 runs out, the elongated body 30*a* is stopped on the track that it remains completely on track half 20*b*. After that, the track 20 is opened and track half 20*b* is moved sideways to a position alongside the third track half 20*c*. The ring-shaped object 11 can now also be replaced with another one if the wrapping of the previous object was completed.

Figure 13:
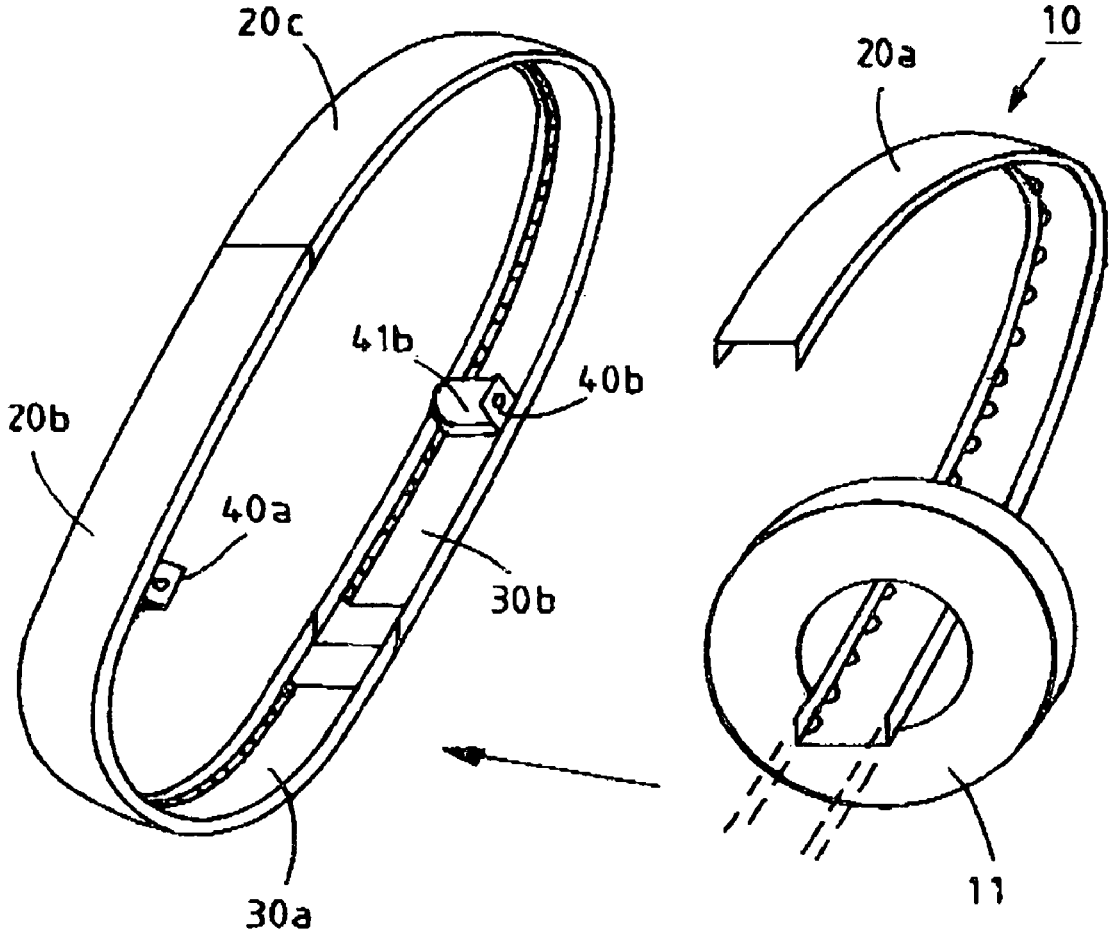

In this situation, track halves 20*b* and 20*c* also form a continuous track as illustrated in FIG. 13, where the elongated bodies 30*a* and 30*b* can change places. In this case, the empty film roll 41 a moves onto track half 20*c* and the full film roll correspondingly moves onto track half 20*b*. After that, track half 20*b* is again moved back into place to connect it to track half 20*a*, whereupon the wrapping of the object 11 can be continued as illustrated in FIG. 12. During the wrapping operation, the empty film roll 41*a* now remaining on track half 20*c* can again be replaced with a full roll, which will thus be ready for the next film roll change.

Figure 14:
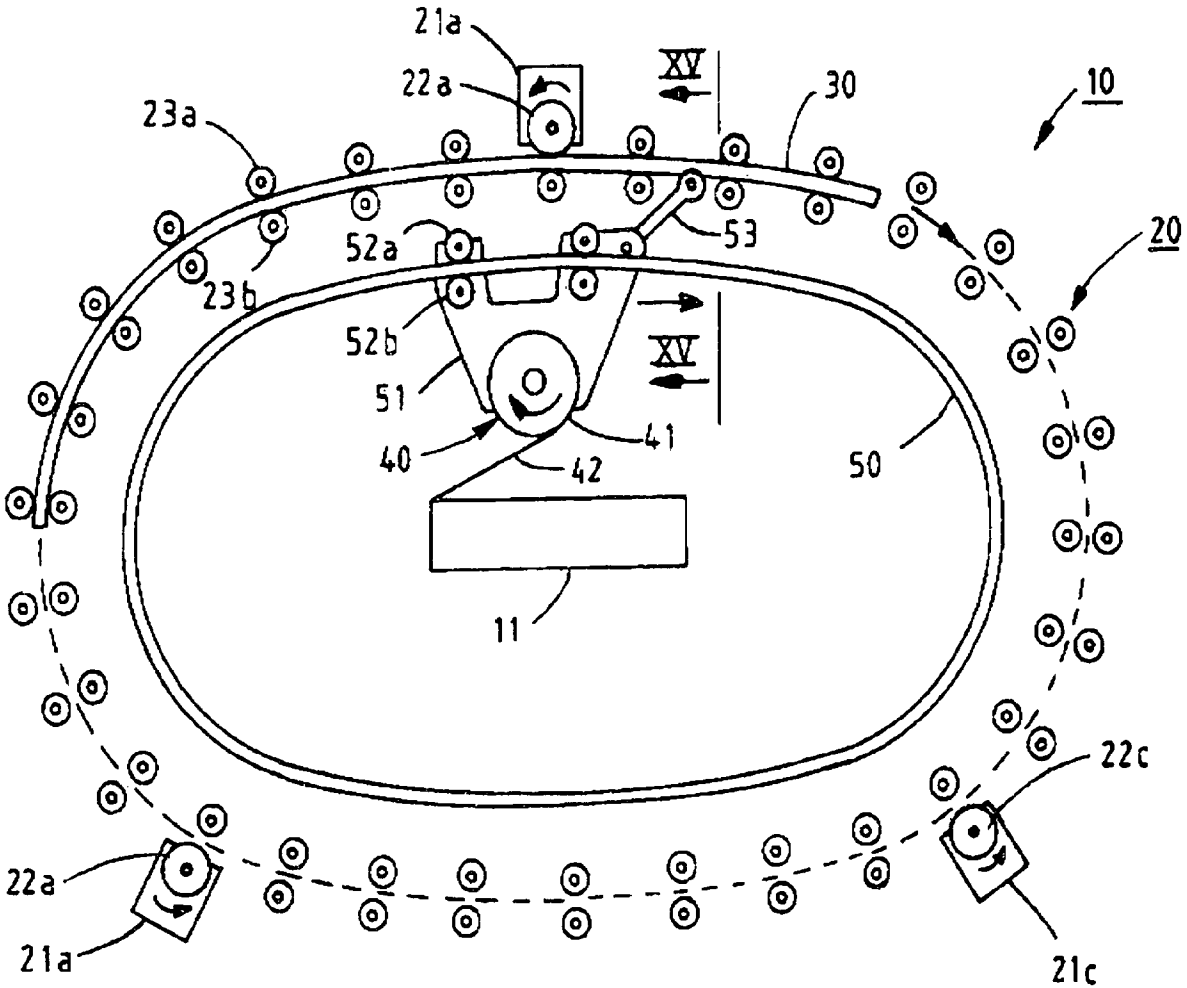

FIG. 14 presents a wrapping packaging machine 10 according to the invention in which the flexible elongated body 30 is placed on a track 20 formed by supporting rollers 23*a* and 23*b* and moved by means of drives 21*a*–21*b* and their drive wheels 22*a*–22*c*. In this embodiment, however, the film feed device 40 and the film roll 41 are not placed on the same track 20 as the elongated body 30. The film feed device 40 and the film roll 41 are placed on a carriage 51 moving along the guide rail 50 of a second separate track, supported by the supporting rollers 52*a* and 52*b* of the carriage 51. The driving device formed by the flexible elongated body 30 is connected to the carriage 51 of the film feed device 40 by a connecting piece 53, which in this embodiment is a connecting rod. However, the connecting piece 53 may also consist of e.g. a wire cable, chain or any other corresponding element.

Since the driving device 30 formed by the elongated body 30 in the solution illustrated in FIG. 14 is placed separately from the film feed device 40 and its track 50, it is also possible to provide old wrapping machines of known types with a new driving device 30 consisting of an elongated body 30 according to the invention.

Figure 15:
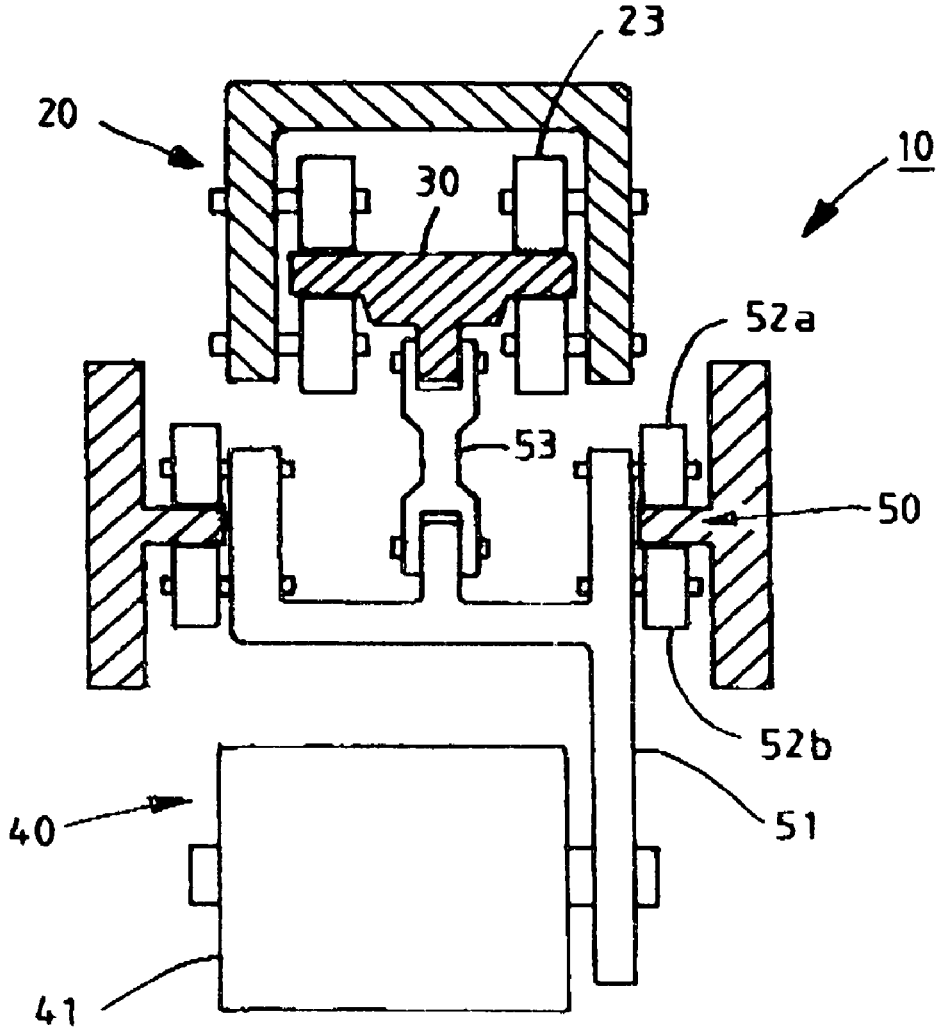

The sectional view in FIG. 15 shows clearly that the track 20 of the wrapping packaging machine 10 and the second track 50 are separate from each other. The flexible elongated body 30 serving as a driving device moves along the track 20 formed by supporting rollers 23*a* and 23*b* while the film feed device 40 is mounted on a carriage 51 that moves along the track formed by the guide rail 50 and is supported by the supporting rollers 52*a* and 52*b* of the carriage 51. The driving device consisting of the elongated body 30 is connected to the carriage 51 of the film feed device 40 by a connecting rod 53, each end of the rod being provided with a pivotal knuckle pin.

Figure 16:
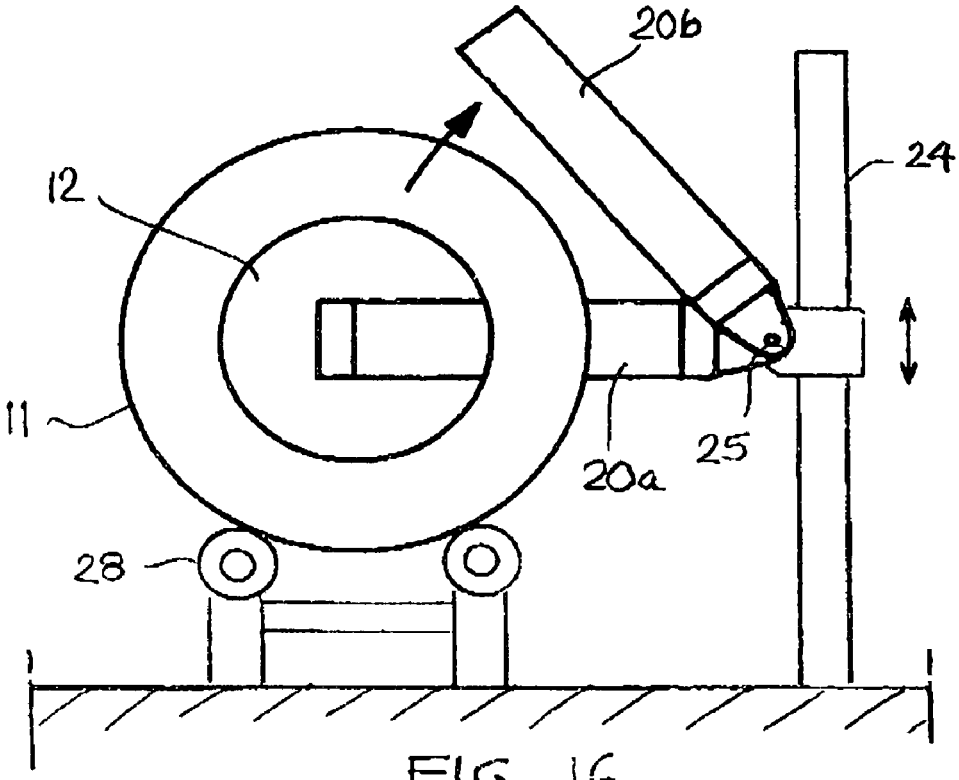

FIG. 16 presents a wrapping packaging machine 10 in which the loop-shaped track 20 connected to an upright column 24. In this case, the track 20 can be raised and lowered as required, depending on the size of the ring-shaped cylindrical object 11 to be wrapped. The track 20 is placed in the middle of the ring-shaped cylindrical object 11 and closed. During the wrapping operation, the ring-shaped cylindrical object 11 rotated on rollers 28.

Figure 17:
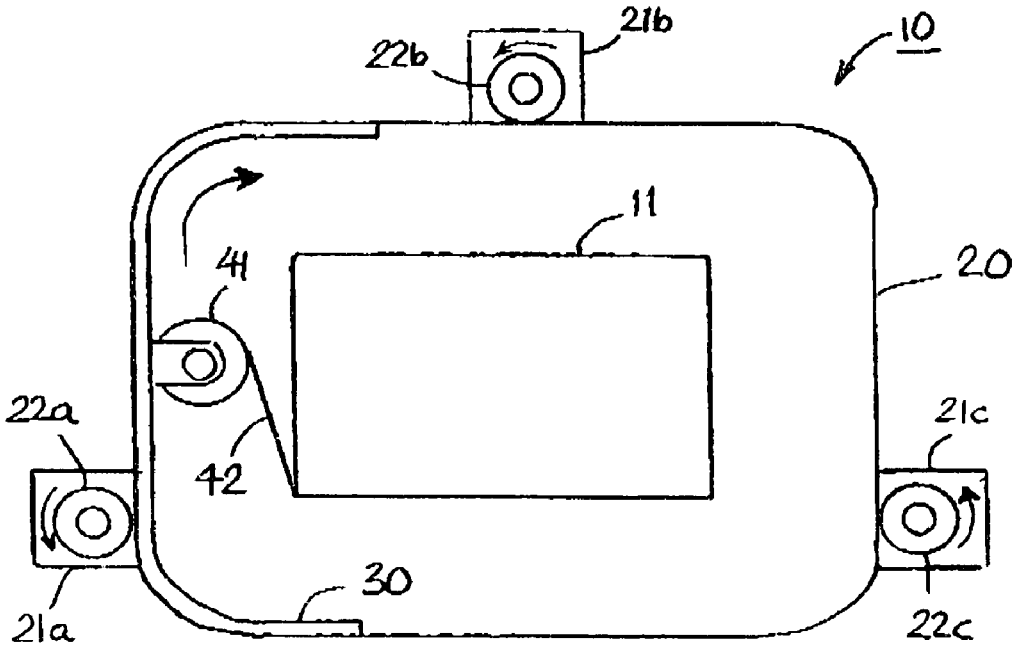

In FIG. 17, the track 20 of the wrapping packaging machine 10 is a rectangle with rounded corners. Such a shape of the track 20 is most advantageous in the wrapping of large rectangular objects 11.

Figure 18:
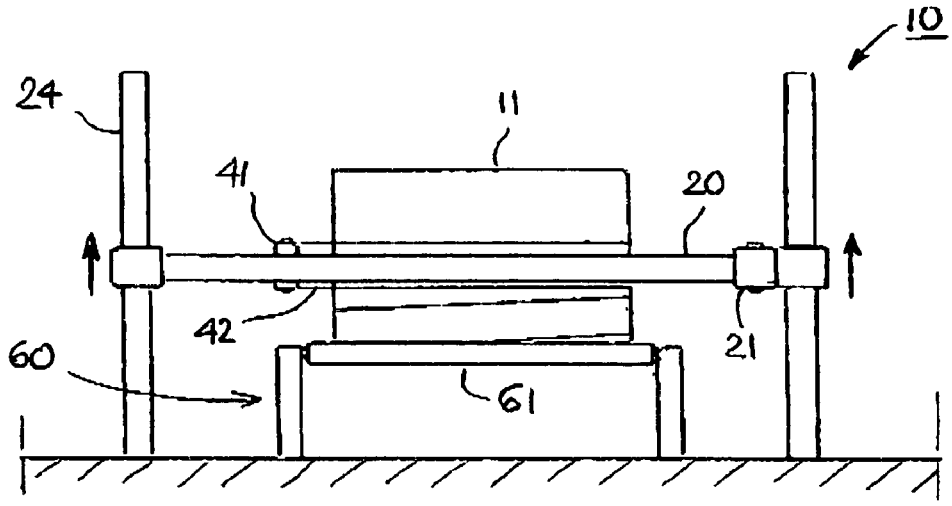

FIG. 18 presents a side view of a wrapping packaging machine 10 with a track 20 disposed in a horizontal plane. The track 20 secured to upright columns 24 so as to allow the track 20 to be raised and lowered. If the object 11 to be wrapped is of rectangular shape, then the track is preferably a rectangle provided with corners of a rounded shape. The drives 21 connected to the track 20 move the flexible body on the track and the film roll 41 mounted on it to wrap a plastic film band 42 around the object 11.

The object to be packaged 11 is moved on the rollers 61 of a conveyor 60 into the wrapping station of the wrapping packaging machine 10. In this situation, the wrapping track 20 is in a raised position supported by the upright columns 24, high enough to permit the object 11 to move under the track 20. By changing the height of the wrapping track 20, the sides of the object 11 can be wrapped completely.

Figure 19:
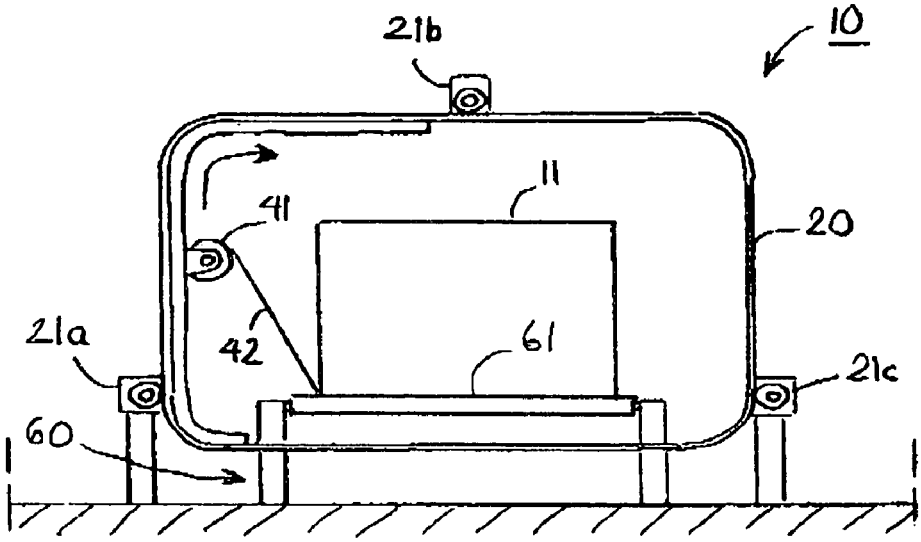

FIG. 19 presents a side view of a wrapping packaging machine 10 in which a rectangular object 11 can be passed through the wrapping track 20 on the rollers 61 of a conveyor 60. In this case, too, the track 20 is preferably a rectangle with rounded corners because it is then possible to pass an object as large as possible through the track 20. Using the wrapping packaging machine 10 presented in FIG. 19, it is possible to wrap two sides and the upper and lower faces of the object 11.

Figure 20:
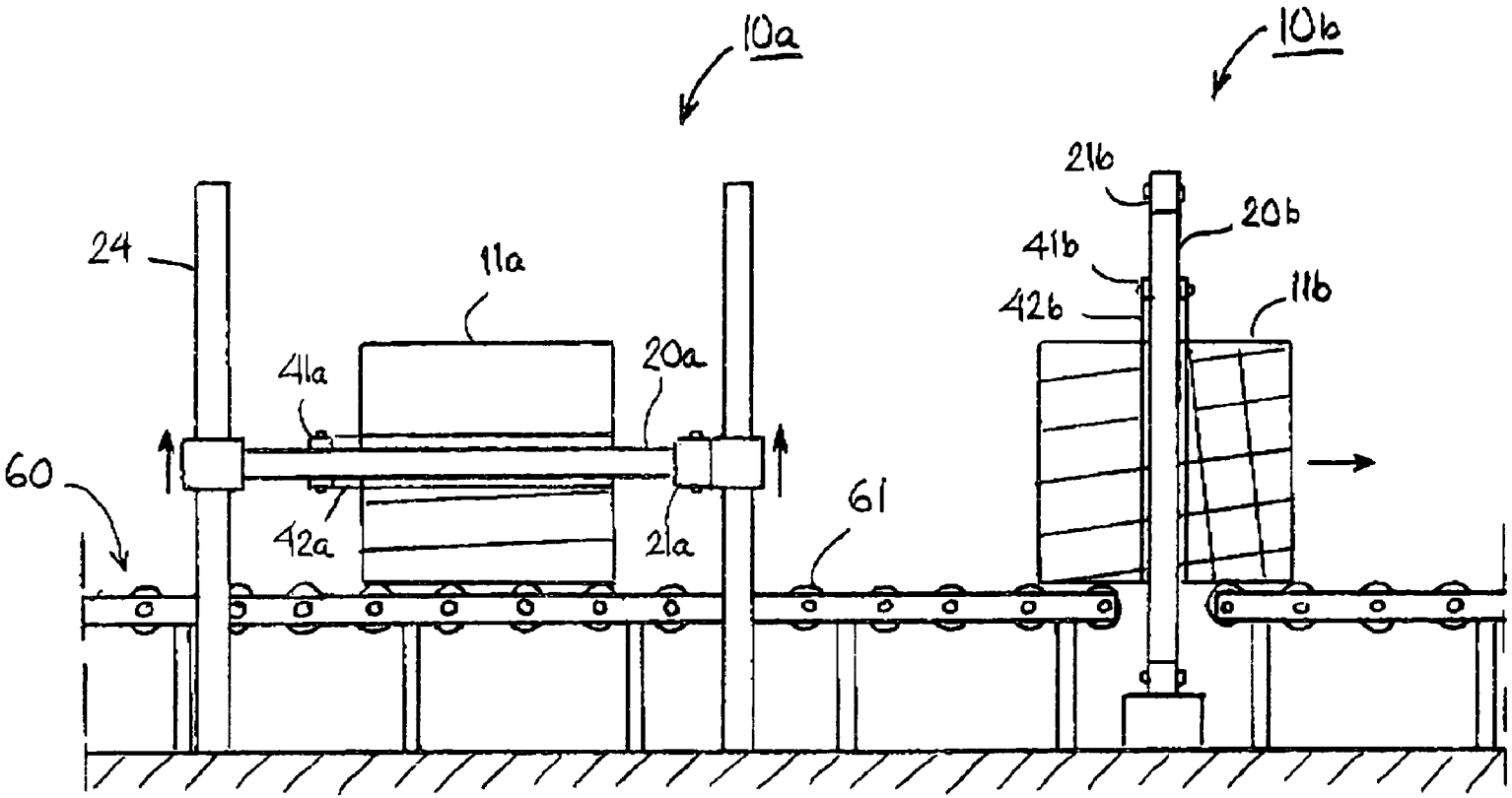

FIG. 20 presents a side view of an aggregate of devices with two wrapping packaging machines 10*a* and 10*b* installed in conjunction with the same conveyor 60 and performing wrapping operations in different planes. The machine on the left-hand side of FIG. 20 is a wrapping packaging machine 10*a* as presented in FIG. 18, provided with a horizontal track 20, and the machine on the right-hand side of FIG. 20 is a wrapping packaging machine 10*b* as presented in FIG. 19, provided with a vertical track 20. In this case, the object to be wrapped 11 is brought from left to right in FIG. 20 on the rollers 61 of the conveyor 60, first to wrapping packaging machine 10*a*, in which the sides of the object 11 are wrapped. After that, the object 11 is moved on the conveyor 60 to the right in FIG. 20 to the second wrapping packaging machine 10*b*, in which, in addition to the two sides of the object 11, its upper and lower faces are wrapped.

Each wrapping packaging machine 10*a* and 10*b* is provided with a wrapping track 20 of rectangular shape with rounded corners. The shapes of the wrapping tracks 20 and the devices 30 and 40 of the invention for transporting the film roll 41 enable objects 11 of a substantially larger size than before to be efficiently wrapped with plastic film 12.

Additional Remarks

It is obvious to the person skilled in the art that different embodiments of the invention may be varied within the scope of the claims presented below. An essential point about the invention is that any shape of the track is possible. The track may also be placed horizontally or vertically. The flexible elongated body of the invention is characterized in that it is alternately either pulled or pushed by the drive. The film feed device may be placed either on the same track directly on the elongated body or on a carriage on a separate guide rail, in which case the elongated body and the carriage are connected together by a connecting element.

List of Reference Numbers

10 wrapping packaging machine
11 object to be packaged
12 aperture
20 track
21 drive
22 drive wheel
23 supporting roller
24 upright column
25 joint
26 endless band
27 diverting pulley
28 roller
30 elongated body
31 roller
32 toothing
40 film feed device
41 film roll
42 plastic film band
43 set of spring rollers
50 guide rail
51 carriage
52 roller
53 connecting rod
60 conveyor
61 roller

The invention claimed is:

1. A wrapping packaging machine (10) for the packaging of an object, said wrapping packaging machine comprising an endless track (20, 50) disposed mainly around an object (11) to be packaged and having a circumference, at least one film feed device (40) carrying at least one wrapping film roll (41) for wrapping a plastic film band (42) around the object (11) to be packaged, and a drive (21, 30) for moving the film feed device (40) around the object (11) to be packaged, characterized in that the drive (21, 30) of the wrapping packaging machine (10) comprises at least one flexible elongated body (30) located on the endless track and having a length which is less than the length of the circumference of the track, and at least two drive elements (22, 26) each mounted in a stationary position relative to the track for moving the flexible elongated body (30) along the track (20), and that at least one film teed device (40) is connected to the elongated body (30) either directly or via at least one connecting element (53), for moving it around the object (11) to be packaged.

2. A wrapping packaging machine (10) according to claim 1, characterized in that it comprises two or more film feed devices (40) connected to the flexible elongated body (30) on the track (20) of the wrapping packaging machine, and that the wrapping film rolls (41) of the film feed devices (40) comprise wrapping film rolls (41) containing similar or dissimilar plastic film bands.

3. A wrapping packaging machine (10) according to claim 1, characterized in that the track (20) of the wrapping packaging machine is of a loop-shaped.

4. A wrapping packaging machine (10) according to claim 1, characterized in that the plane passing through the track (20) of the wrapping packaging machine is vertical or horizontal.

5. A wrapping packaging machine (10) according to claim 1, characterized in that the flexible elongated body (30) on the track (20) is made of material adaptable to the shape of the track.

6. A wrapping packaging machine (10) according to claim 1, characterized in that a drive wheel (22) in the track (20) is a friction wheel for moving the flexible elongated body (30) on the track by friction.

7. A wrapping packaging machine (10) according to claim 1, characterized in that the flexible elongated body (30) on the track (20) is a chain adaptable to the shape of the track.

8. A wrapping packaging machine (10) according to claim 1, characterized in that a drive wheel (22) in the track (20) is a toothed wheel, and that the flexible elongated body (30) on the track (20) is provided with a toothing (32) corresponding to the teeth of the toothed wheel and engaging the toothed wheel.

9. A wrapping packaging machine (10) according to claim 1, characterized in that the loop-shaped track (20) of the wrapping packaging machine (10) can be opened to allow the track to be placed so that it runs through a ring-shaped object (11) to be packaged, that the elongated body (30) can be moved on the loop-shaped track (20) to wrap a plastic film band around the ring-shaped object (11).

10. A wrapping packaging machine (10) according to claim 1, characterized in that an openable track (20) having the shape of a closed loop of the wrapping packaging machine (10) has been formed from two parts (20*a*, 20*b*), at least one of which can be moved sideways perpendicularly to the plane off the track.

11. A wrapping packaging machine (10) according to claim 1, characterized in that the flexible elongated body (30) is a flexible rod, band or chain.

12. A wrapping packaging machine (10) according to claim 1, characterized in that the at least two drive elements (22, 26) are a drive wheel (22) or an endless band (26).

13. A wrapping packaging machine (10) according to claim 3, characterized in that the track (20) of the wrapping packaging machine is of a circular or oval form or a rectangular track with rounded corners.

14. A wrapping packaging machine (10) according to claim 3, characterized in that the connecting element is a connecting rod (53).

15. A wrapping packaging machine (10) according to claim 1, characterized in that an openable track (20) having the shape of a closed loop of the wrapping packaging machine (10) has been formed from two parts (20*a*, 20*b*) with a joint (25) between them, and that at least one (20*a*) of the two parts of the track (20) can be turned sideways about the joint (25) so that the planes passing through the track parts form an acute angle between themselves.

16. A wrapping packaging machine (10) according to claim 1, characterized in that the wrapping packaging machine (10) comprises means (50) for removing the elongated body (30*a*) from the loop-shaped track (20) and/or for feeding the elongated body (30*b*) onto the loop-shaped track when at least one (20*a*) of the track parts has been moved or turned aside.

17. A wrapping packaging machine (10) according to claim 1, characterized in that the wrapping packaging machine (10) comprises two tracks (20, 50), of which a first track (20) carries the flexible elongated body (30) while a second track (50) carries at least one carriage (51) provided with at least one film feed device (40).

18. A wrapping packaging machine (10) according to claim 17, characterized in that the first track (20) of the wrapping packaging machine (10) is an outer track which carries the elongated body (30), which is supported by bearing rollers (23), while the second track is an inner track consisting of a guide rail (50) which supports the carriage (51) of the film feed device (40), and that the flexible elongated body (30) and the carriage (51) are connected together by a connecting element.

19. A wrapping packaging machine (10) according to claim 1, characterized in that the wrapping packaging machine (10) consists of an aggregate comprising a conveyor (60) and, in conjunction with it, two wrapping packaging machines (10*a*, 10*b*) performing wrapping operations in different planes, the wrapping tracks (20*a*, 20*b*) of said machines being perpendicular to each other.

* * * * *